United States Patent [19]

Grabbe

[11] Patent Number: 5,059,143

[45] Date of Patent: Oct. 22, 1991

[54] CONNECTOR CONTACT

[75] Inventor: Dimitry G. Grabbe, Middletown, Pa.

[73] Assignee: AMP Incorporated, Harrisburg, Pa.

[21] Appl. No.: 241,649

[22] Filed: Sep. 8, 1988

[51] Int. Cl.[5] ..... H01R 9/24

[52] U.S. Cl. ..... 439/886; 439/887; 439/840; 439/927

[58] Field of Search ..... 439/66, 89, 91, 591, 439/840, 841, 886, 927, 887, 816

[56] References Cited

U.S. PATENT DOCUMENTS

| | | | |
|---|---|---|---|
| 3,308,229 | 3/1967 | Burniston | 439/841 |
| 3,795,884 | 3/1974 | Kotaka . | |
| 3,951,493 | 4/1976 | Kozel | 439/591 |
| 3,954,317 | 5/1976 | Gilssen et al. | 439/591 |
| 3,960,424 | 6/1976 | Weisenburger | 439/66 |
| 4,352,531 | 10/1982 | Gutter . | |
| 4,516,820 | 5/1985 | Kuzma | 439/271 |
| 4,529,257 | 7/1985 | Goodman et al. | 439/271 |

FOREIGN PATENT DOCUMENTS

| | | | |
|---|---|---|---|
| 409044 | 9/1966 | Switzerland | 439/841 |

OTHER PUBLICATIONS

Electrical World; Copper Range Co., Jun. 1970, pp. 82 cl 439 sc 887.

Electronic Design; Sep. 1965, pp. 34–37, Michael A. Grundfest.

*Primary Examiner*—David L. Pirlot

*Attorney, Agent, or Firm*—James M. Trygg

[57] ABSTRACT

The present disclosure sets forth a unique contact structure for a separable electrical connector for carrying relatively high levels of current at high frequency in a high temperature environment. The contact utilizes a high loading spring design which permits a relatively low resistance and low inductance contact element. The contact element takes either of two forms. One form being a multiple wire spring formed in an open helical pattern and the other being a number of c-shaped contact elements arranged in concentric circles on a thin disk.

16 Claims, 6 Drawing Sheets

CONNECTOR CONTACT

The present invention relates to a current carrying contact structure in a separable electrical connector for carrying relatively high current at high frequency in a high temperature environment.

BACKGROUND OF THE INVENTION

When terminating an electrical conductor which is intended to carry relatively high current at relatively high frequency, care must be taken to keep current density at the termination within reasonable limits so that high resistance paths are not inadvertently created. Typically, such high current high frequency applications include high energy pulses for laser devices where the pulse rise time is less than one nanosecond per volt, and induction heating systems and other electromagnetic systems requiring high frequency energy of 10 kilohertz or more.

Such systems may, for example, require continuous current flow of as much as 5,000 amperes with peak demands of 20,000 amperes for short periods of time. Due to short rise time pulses or high frequency alternating current, current flow through the conductor is limited to a portion of the conductor close to its surface. This phenomenon is known in the industry as "skin effect." Additionally, self and mutual inductance of the conductors acts as a choke, further limiting current flow at certain frequencies.

"Skin effect" is the terminology used to describe the tendency for alternating currents to concentrate and flow in the outer region of a conductor. This outer region is defined by the "skin depth" such that, for a circular cross-section, this depth is measured inward from the conductor's surface. Most of the total current flows within this region. Therefore, one finds that the AC resistance of a wire is greater than the DC resistance of that same wire due to the reduced effective cross-sectional area through which the current must pass. The precise value of the skin depth for a circular cross-section is defined as:

$$\text{skin depth} = \frac{1}{\sqrt{\pi f \mu \sigma}}$$

where:

f=frequency $\mu$=permeability $\sigma$=conductivity

Attempts to overcome these problems by utilizing multiple conductors in parallel have met with some success. Multiple insulated conductor strands in close, parallel proximity exhibit about a 50% reduction of inductance over a single strand conductor. Such multi-strand conductors, now commercially available, are typically composed of thousands of very small diameter wires, each of which is insulated by a thin coating of varnish such as polyimide, or some other insulating material such as epoxy.

Such multi-strand cables being used for the transmission of high frequency and high current energy, are often subjected to high ambient temperatures due to the nature of the devices utilizing the transmitted energy. Induction heating systems, for example, frequently produce an ambient temperature near the power cable of about 300° C. This relatively higher temperature causes a decrease in conductivity which, in turn, causes an increase in the skin depth. For example, using a copper conductor and current at 10 kHz, a change from room temperature to 300° C. will result in about a 45% increase in skin depth.

Connectors for removably connecting these cables to their respective equipment must, therefore, be able to transmit the high frequency, high current energy without imposing high resistance paths. Further, the separable parts of these connectors must not have a tendency to stick or weld together. The contacts that conduct the current between the two halves of the connector are particularly vulnerable to sticking or welding because they must be in intimate contact with some surface of each side of the connector. This intimate contact is generally one of somewhat high pressure, and when considering the high current flow, the high temperature environment has a tendency to cause thermocompressive bonding or some other similar sticking mechanisms to come into play effects are well known in the industry Such Another consideration when designing such contacts is the resistance inherent in these contacts as well as self and mutual inductance of the conductors due to the AC current at certain frequencies.

What is needed is a contact structure which will conduct relatively high currents at high frequency and a high temperature environment without the contacts fusing, bonding, or welding to their contacting surfaces.

SUMMARY OF THE INVENTION

The present invention relates to a contact structure for carrying relatively high current at high frequency and a high temperature environment The connector includes first and second opposed contacting surfaces. Each surface is connected to an electrical conductor. A contact means is included for providing a current path between the two contacting surfaces This contact means comprises a plurality of contacts disposed on a resilient structure having an arcuate shape. The contacts are arranged in pairs of proximate contacts so that one contact of one of these pairs of contacts is in current carrying engagement with one of the contacting surfaces and the other contact of the pair is in current carrying engagement with the other contacting surface.

A BRIEF DESCRIPTION OF THE DRAWINGS

DESCRIPTION OF THE PREFERRED EMBODIMENT

Figure 1:
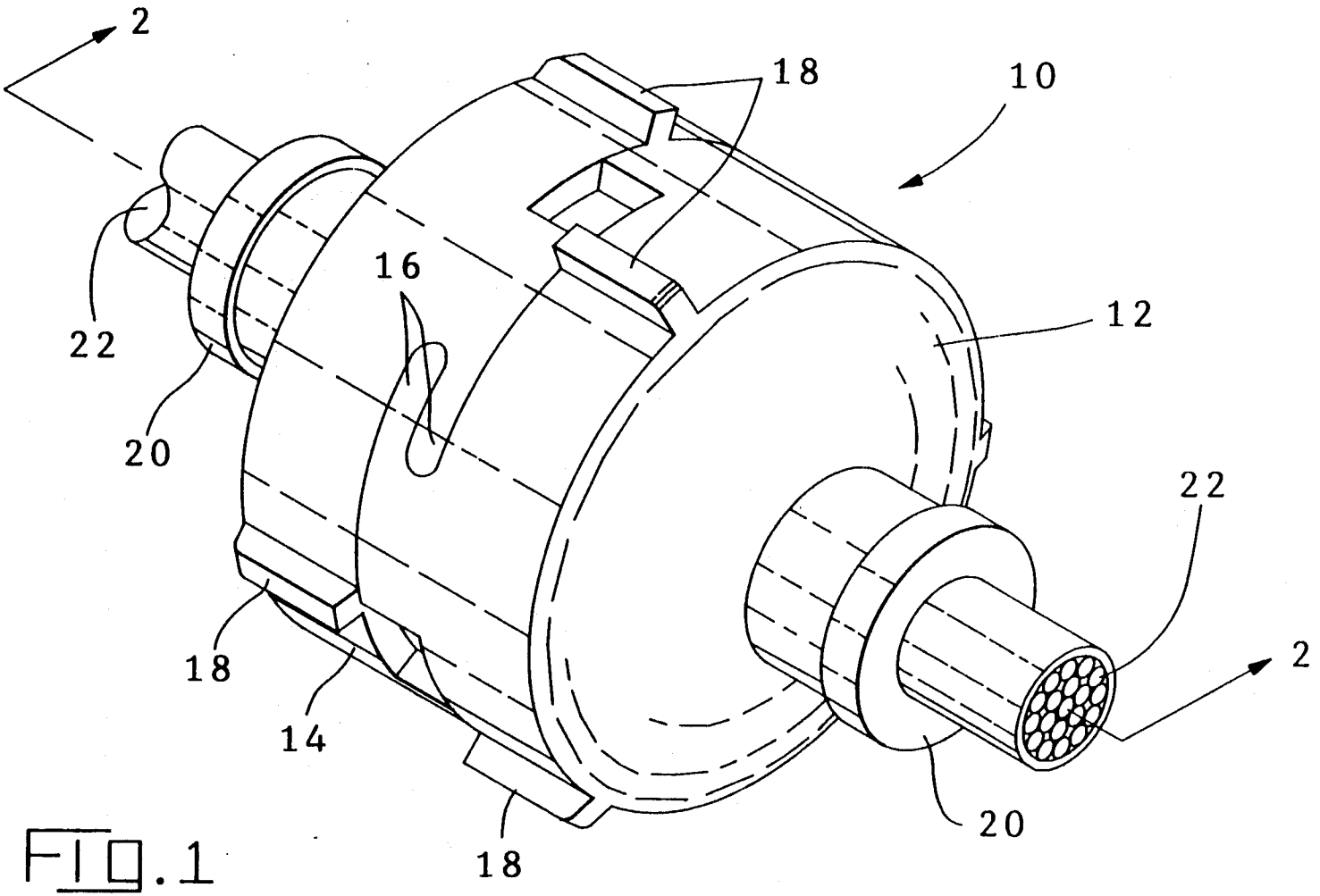
FIG. 1 is an isometric view of an in-line connector.
Figure 2:
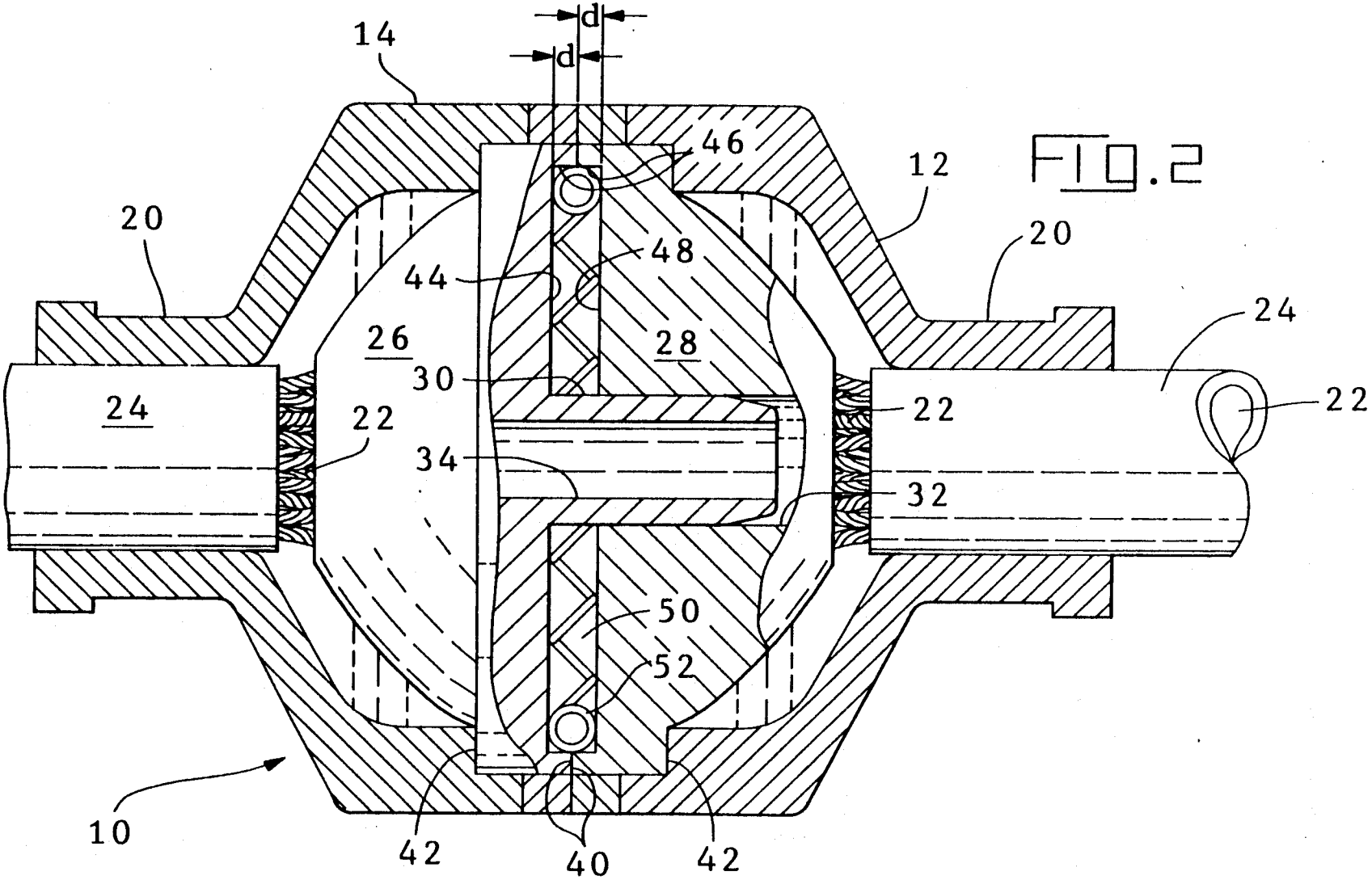
FIG. 2 is a cross sectional view of the connector of FIG. 1 taken along the lines 2—2, incorporating the teachings of the present invention.

There is shown in FIG. 1 an in-line connector 10 having a right housing half 12 and a left housing half 14 which are in interlocking engagement by means of the mutually interlocking fingers 16. While the two housing halves 12 and 14 are shown identical, they may be made somewhat different to satisfy the needs of a particular application without departing from the teachings of the present invention. The actual structure of the interlocking fingers 16 of the housing halves 12 and 14 are unimportant to the practice of the present invention and are, by way of example, illustrative of a structure that is suitable to employ the teachings of the present invention. The housing halves 12 and 14 must be made from a material that will not weld at 300° C., such as passivated stainless steel. This will help to assure that the connector 10 can be separated after being in use. Wrench lugs 18 are spaced about the periphery of the housing halves 12 and 14, as is common in the industry, to facilitate assembly and disassembly of the two halves. Each housing half 12 and 14 includes a strain relief portion 20 for receiving a cable 22. The connector 10, embodying the teaching of the present invention, is more clearly shown in section in FIG. 2. Each cable 22, as seen in FIG. 2, includes an outer insulating and protective covering 24. A pair of intermating terminals 26 and 28 are shown disposed within the connector housing halves 14 and 12, each terminal having a cable 22 electrically terminating therewith. The termination of the cables 22 to the terminals 26 and 28 must be effected in a way to not create a high resistance path in the transmission of current from one side of the connector to the other. Any suitable termination well known in the industry, such as welding, may be used. The terminal 26 includes a projection 30 which is formed substantially on the longitudinal axis of the connector 10 and slidingly mates with a bore 32 formed in the other terminal 28, as shown in FIG. 2. This facilitates alignment of the two connector halves when joining them together. A central bore 34 formed through the projection 30 and the terminal 26 provides a passage way interconnecting the two cables 22 and the interior of the connector 10 so that a cooling gas may be passed therebetween in a manner that is well known in the industry. Each terminal 26 and 28 has an abutting face 40 and a clamping face 42. With the two connector halves 12 and 14 an interlocking engagement as shown in FIG. 2 the clamping faces 42 are urged toward each other so that the faces 40 are held in mutual abutting contact. The terminal 26 has a contacting surface 44 undercut in the face 40 having a diameter 46 which is substantial concentric with the projection 30. The depth d of the undercut is related to the contact structure as will be described below. Similarly, the terminal 28 has a contacting surface 48 undercut into the face 40 having a diameter 46 that is substantially concentric with the bore 32. This undercut also has a depth equal to d.

In an ambient temperature of about 300° C. and a requirement to conduct, for example, about 10,000 amperes at a frequency of about 10 kilohertz, a substantial number of contacts would be required to adequately conduct current between the two contacting faces 44 and 48. In practical terms an individual contact, at these temperatures, would be limited to about 14 amperes. In order to conduct such high current under these conditions an area is required which would permit placement of a sufficient number of contacts, side by side, each carrying its share of current to satisfy the total current requirements. Additionally, the current path from one contact in contact with the surface 44 and a corresponding contact with the surface 48 must be sufficiently small so that a low resistance path between the two contacting surfaces is maintained. Additionally the structure of these contacts must be such that mutual and self induction is not present, or is relatively small.

Figure 5:
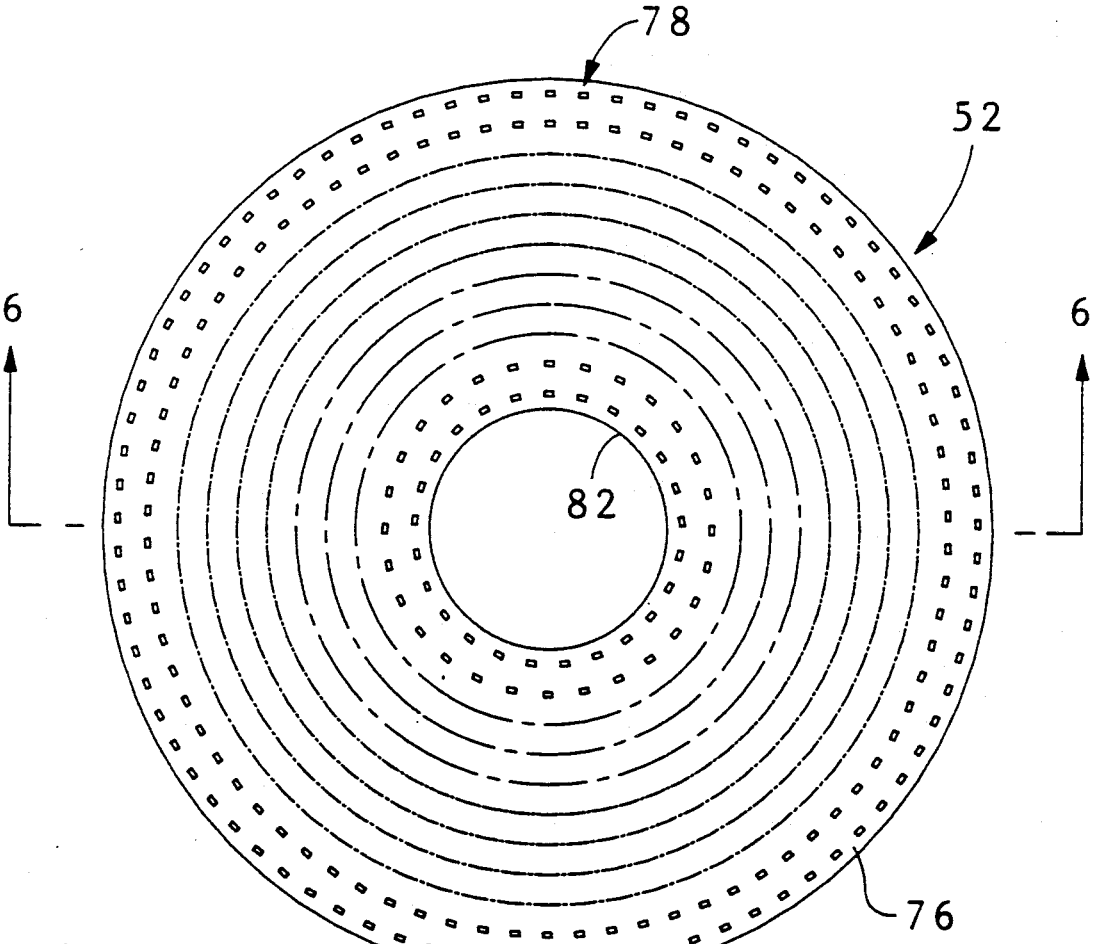
FIG. 5 is a plan view of another embodiment of a contact structure for the connector shown in FIG. 2.
Figure 6:
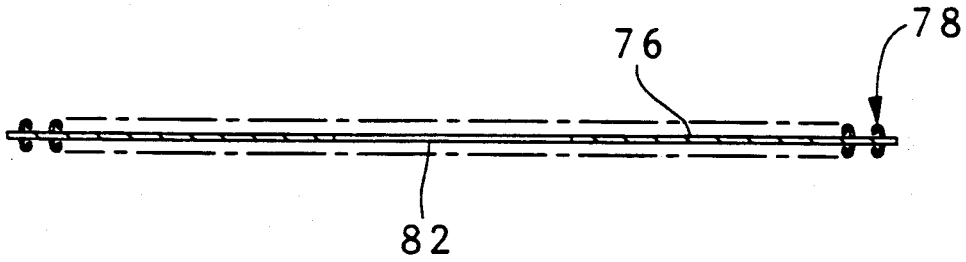
FIG. 6 is a cross-sectional view taken along the lines 6—6 of FIG. 5.
Figure 7:
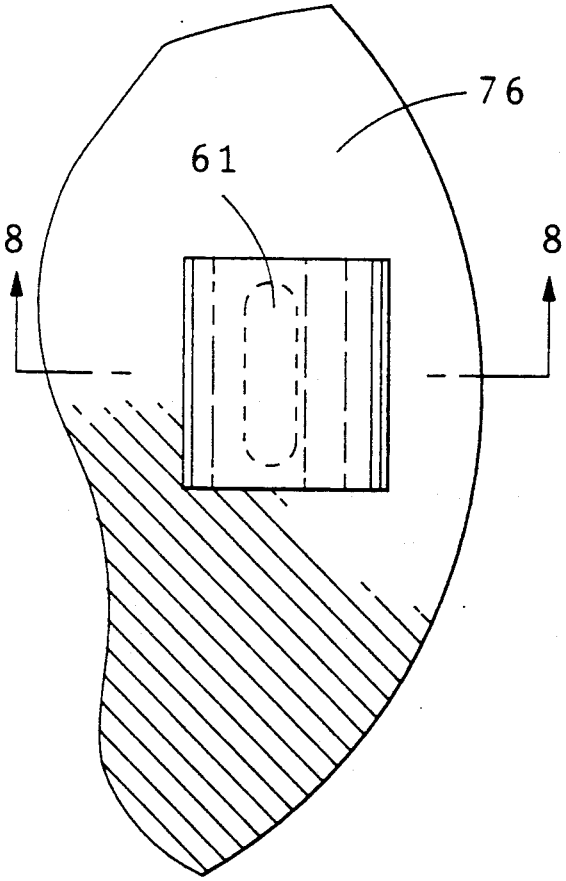
FIG. 7 is an enlarged view of the portion of FIG. 6 that is indicated at 7.

The present invention accomplishes this by very closely controlling the depth d of the contacting surfaces 44 and 48 so that an arcuate contact element may be disposed therebetween having a high loading to deflection profile or high spring rate. The exact spring rate, or force/deflection slope, of the contact element is chosen to yield a relatively low electrical resistance while remaining within the practical limits of the dimensional tolerance of the mating parts. This enables the use of very small contact elements thereby minimizing induction and resistance problems. With the connector 10 assembled as shown in FIG. 2 the contacting surfaces 44 and 48 and the diameter 46 form a cavity 50 having a width *2d* for containing an array 52 of contact. Two embodiments of such an array 52 of contacts is shown in FIGS. 3 and 5.

Figure 3:
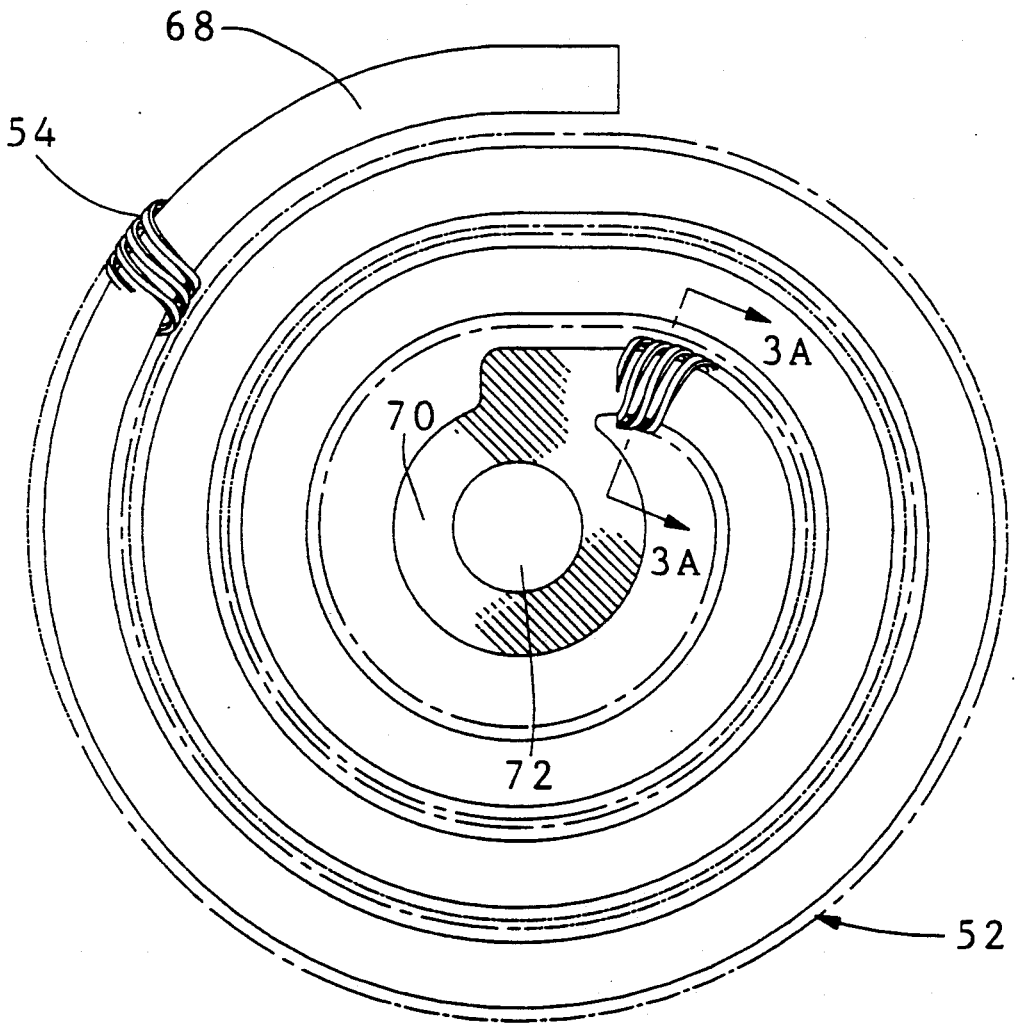
FIG. 3 is a plan view of a contact structure for the connector of FIG. 1.
Figure 4:
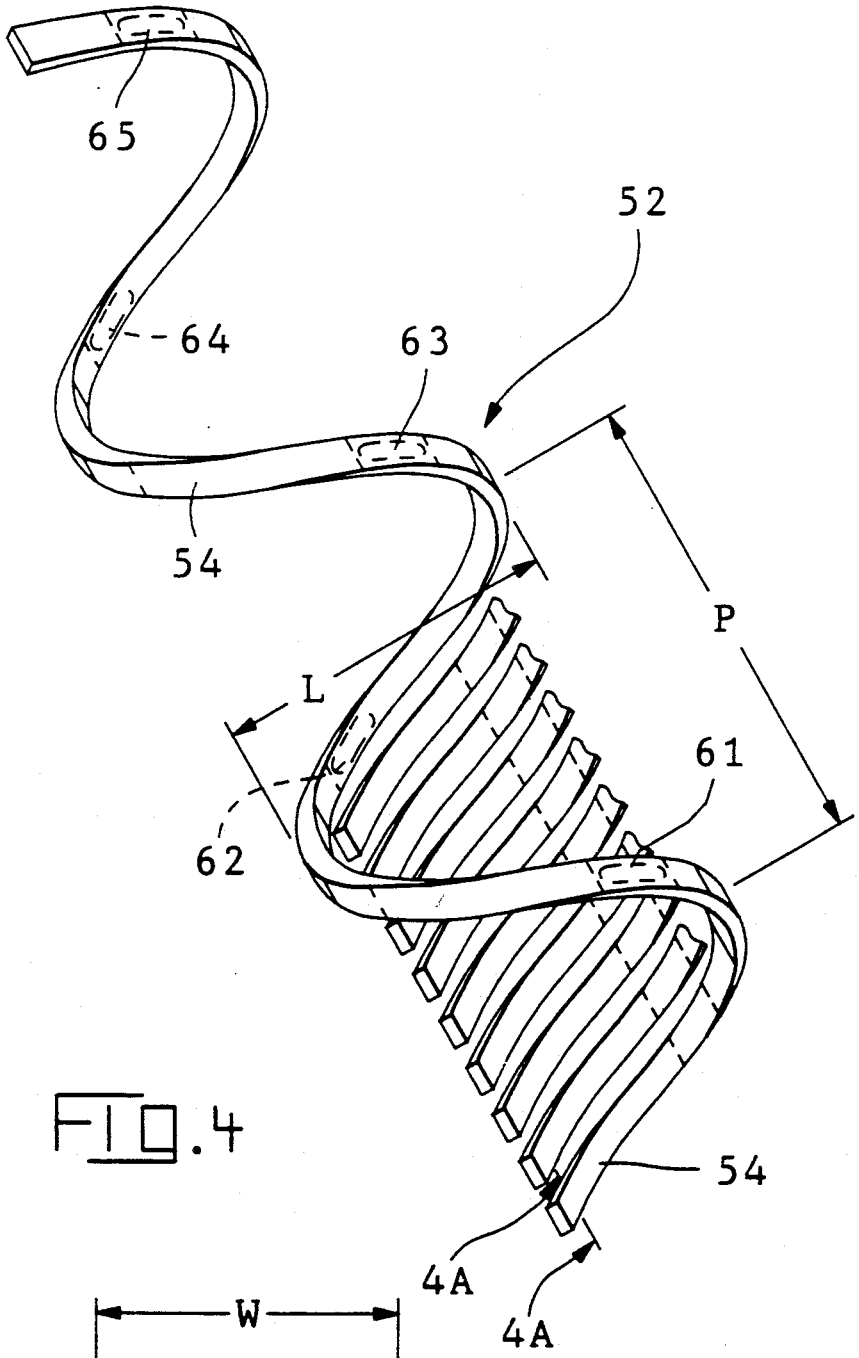
FIG. 4 is an isometric view of a portion of the contact structure shown in FIG. 3.
Figure 4A:
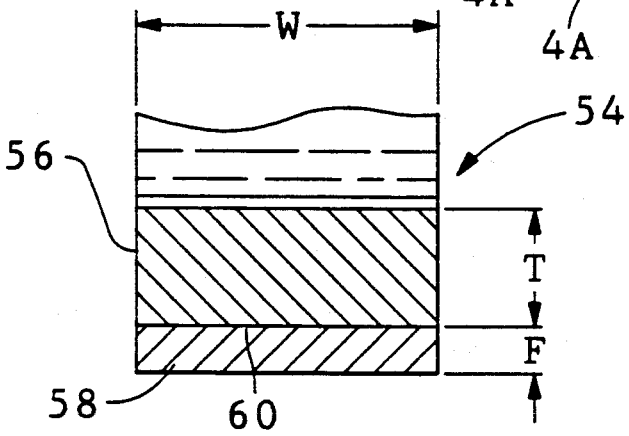
FIG. 4A is a cross-sectional view taken along the lines 4A—4A of FIG. 4.

As shown in FIG. 3 the first embodiment of the array 52 of contacts comprises a series of open helical springs 54 formed in a torus shape. Each individual spring 54 is formed from wire having a rectangular cross section as shown in FIGS. 4 and 4*a*. The spring 54 may be made of any material suitable for a spring having an anneal temperature substantially above 300° C. and having an outer cladding layer for conducting the current and making a low resistance contact. The outer cladding layer must be of relatively high conductivity, having a resistivity of about 0.1 ohm $cm^{-2}$ or less, and must not be susceptible to thermocompressive bonding to the contacting surfaces. The spring 54 is made by winding the clad wire about a mandrel in the usual way to effect an open helical pattern having an outside diameter indicated as L and a pitch indicated as P as shown in FIG. 4. The diameter L is chosen to be slightly larger than the depth *2d* of the cavity 50 by an amount that when compressed within the cavity 50, as shown in FIG. 2, will provide sufficient contact pressure at the contact points on the spring 54 that engage the contacting surfaces 44 and 48. This of course will be a function of the dimensions of the cross section of the wire and the material from which the wire is made. In the present example the wire used to make the resilient portion 56 of the spring 54 was INCONEL X having a width w of 0.032 inches and a thickness t of 0.015 inches. INCONEL X is a corrosion resistant alloy of nickel chromium that is commercially available from Huntington alloys, a division of Inco Alloys International of Huntington, West Virginia 25720. INCONEL X is a trademark of Inco Alloys International.

It was wound about a mandrel having a diameter of 0.252 inches resulting in a spring diameter L of 0.300 inches. The cladding layer 58, composed of a mixture of between about 70% and about 90% silver and the remaining of cadmium oxide is disposed on the outer surface 60, which is a major surface, of the spring 54. In the present example the mixture consisted of approximately 85% silver and 15% cadmium oxide. This layer 58 is formed on the surface 60 of the resilient portion 56 prior to forming the spring 54. The layer 58 may be formed by any suitable means known in the industry. This is typically done by compacting the mixture of silver and cadmium oxide into a sheet having a thickness substantially greater than the desired thickness F of the finished cladding layer 58, as seen in FIG. 4A. The layer of compacted material is then silver plated on one side, which is in turn silver soldered to a surface of a sheet of INCONEL X having a thickness slightly greater than the thickness T shown in FIG. 4A. The composite structure is then precision rolled to the thickness desired. It will be understood that the compacted layer of silver and cadmium oxide is considerably more soft than the INCONEL X and therefor must have a correspondingly greater thickness relative to its final thickness. The rolled composite sheet is then slit into long strips, each having a desired width W. as shown in FIG. 4A. In the present example the width W is about 0.030 inches and the thicknesses T and F about 0.015 and 0.006 inches respectively. The long strips are then wound about a cylindrical mandrel in the usual manner to form the open helical pattern of the spring 54 as seen in FIG. 4. The layer 58 disposed on the surface 60 then becomes the principal current conducting path between the terminals 26 and 28. The layer 58, contacts the contacting surfaces 44 and 48 at the points 61, 62, 63, 64, and 65 as indicated in FIG. 4. Note that the points 62 and 64 are in contact with one of the contacting surfaces while the points 61, 63, and 65 are in contact with the other contacting surface. Therefore current flow from the one contacting surface would enter the layer 56 at the points 62 and 64 conduct through the layer 56 and exit to the other contacting surface at the contact points 61, 63, and 65. The contacts 61 through 65 can be thought of as being pairs of proximate contacts, that is, contacts 61 and 62 would be a pair and contacts 63 and 64 would be a pair, and so on. In this case current would enter a contact 64 and flow through the layer 58 in both directions towards the contact 63 and toward the contact 65. It will be understood that substantially all current flow will be through the layer 58 at the exclusion of the resilient portion 56. Therefore, the current path is limited to a single surface of the spring 54. This avoids a problem which is common with more conventional contacts which conduct current through the contact from one side to the other. In those cases, due to skin effect, the current must be conducted around the edge which would be in the present case the thickness t as shown in FIG. 4*a* thus causing a high constriction resistance in the current path.

The diameter L of the helical coil spring 54, is chosen to minimize resistance to current flow and self and mutual inductance. This is done by making the diameter L as small as possible. As the diameter L is made smaller, however, the amount of radial deflection of the individual coils which occurs when the two terminals 26 and 28 are in abutting engagement must be correspondingly smaller to assure that the coil does not take a set and deform permanently. This in turn requires that the distance 2*d* between the two contacting surfaces 44 and 48 be controlled very closely. This, of course, results in increased manufacturing costs. In order to stay within the elastic limits of the spring 54 and yet reduce the diameter 6 below that which would ordinarily be thought possible, the pitch P is increased substantially. This results in a portion of the deflection of the coil to be a torsional deformation thereby reducing the effect of radial deflection. This in turn permits more variation in the distance 2*d* between the two contacting surfaces 44 and 48. As the pitch P is increased, however, there is more space between the contacts 61 and 65. In order to utilize this space for contacts, a series of springs 54 having identical dimensions and pitch P are simultaneously wound on a mandrel. This results in a multiple spring open helical pattern, as shown in FIG. 4. It will be appreciated that each of the helical springs 54 will have areas of contact similar to the contacts 61 through 65, including pairs of proximate contacts as set forth above. Note that both contacts of a pair of proximate contacts must be located on the same spring 54, therefore, two contacts 61 which are on adjacent springs 54 are not proximate contacts in the meaning intended herein.

Figure 3A:
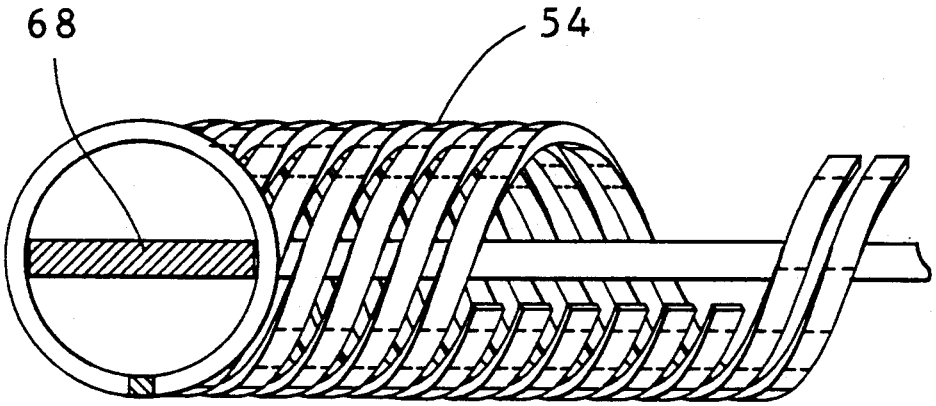
FIG. 3A is a cross-sectional view taken along the lines 3A—3A of FIG. 3.

As is best seen in FIGS. 3 and 3A, the array 52 of contacts comprises the multiple springs 54, as depicted in FIG. 4, threaded onto a somewhat spiral shaped support 68. The support 68, in the present example, is brass having a rectangularly shaped cross section, as shown in FIG. 3A, and dimensioned to easily slide within the interior of the multiple springs 54. At the interior end of the spiral, the support 68 terminates into a hub 70 having a central hole 72 which loosely fits over the projection 30 of the terminal 26. Note that the spiral of the array 52 has a number of turns to assure a sufficient quantity of contacts to carry the desired level of current. The purpose of the support 68 is to properly position the multiple springs 54 within the cavity 50 while assembling the two connector halves 12 and 14.

The connector is assembled by placing the array 52 of contacts against the contacting surface 44 with the projection 30 projecting through the hole 72. The other half 12 of the connector is then brought into-alignment and the projection 30 inserted into the bore 32. The two connector halves 12 and 14 are then urged together. As the interlocking fingers 16 begin to lockingly engage, the contacts of the array 52 engage the two contacting surfaces 44 and 48. Relative twisting of the two housing halves 12 and 14 cause a camming action by the fingers 16 to compress the array 52 of resilient contacts a very precise amount until the abutting faces 40 are forced into abutting contact.

The contacting surfaces 44 and 48 of the terminals 26 and 28 may also advantageously include a layer of a mixture similar to that of the layer 58 this will assure good current conducting contact between the array of contacts 52 and the contacting surfaces 44 and 48 and substantially eliminate the chance of bonding, welding, or fusing of the contacts 61 through 65 to their respective contacting surfaces 44 and 48 during use.

A second embodiment of the array 52 of contacts is shown in FIGS. 5 through 9. In the following description, parts which are similar in both the first and second embodiments have the same identifying symbols. As shown in FIG. 5, the array 52 of contacts consists of a relatively thin disk 76 and a number of c-shaped contact elements 78 held captive in perforations 80 formed in the disk 76. The c-shaped elements 78, in the present example, are arranged in substantially concentric circles as shown in FIG. 5. However, any suitable pattern, whether symmetrical or not, which allows for a sufficient quantity of elements 78 will work. A central hole 82, which is substantially concentric with the outer periphery of the disk 76 is sized to loosely fit over the projection 30 of the terminal 26. Further, the outer periphery of the disk 76 is sized to loosely fit within the diameter 46 and into the cavity 50. In the present example, the disk 76 has an outside diameter of about 3.75 inches and contains about 324 c-shaped contact elements 78 arranged in 21 concentric circles. This is sufficient to conduct over 4500 amperes of current.

Figure 8:
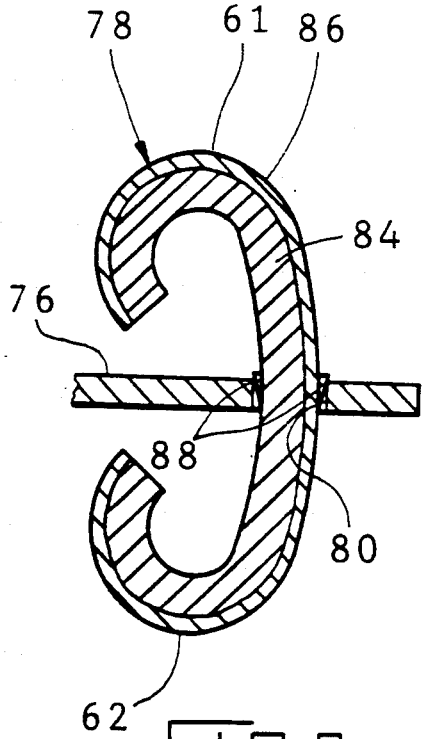
FIG. 8 is a partial cross-sectional view taken along the lines 8—8 in FIG. 7.
Figure 9:
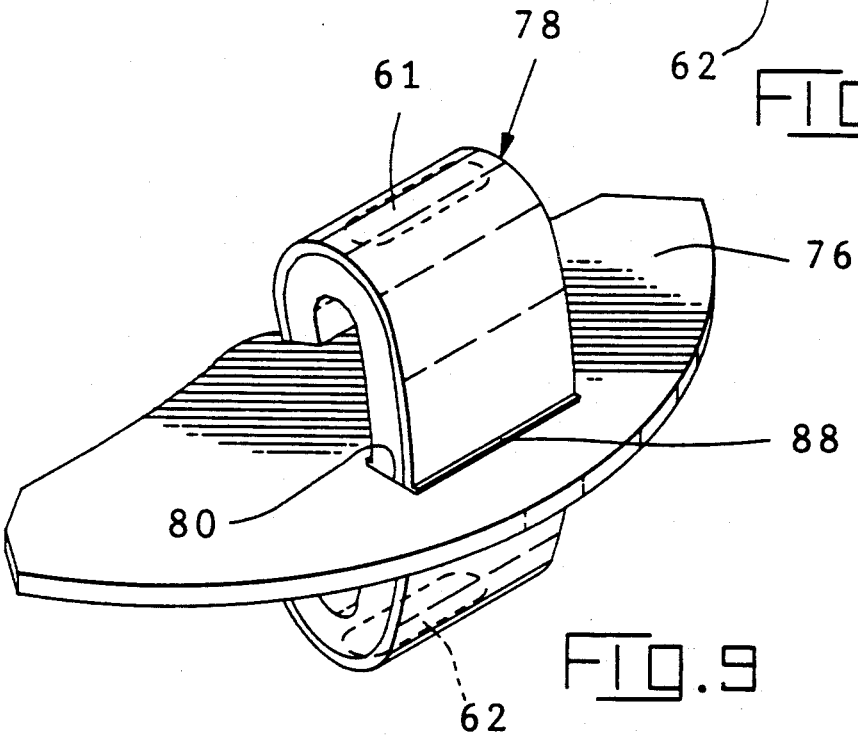
FIG. 9 is an isometric view of the contacting element of the contact structure shown in FIG. 5.

The c-shaped contact elements 78 are made from a sheet of material identical to that from which the springs 54 of the first embodiment are made. That is, the element 78 consists of a resilient portion 84 and a cladding layer 86, similar to the resilient portion 56 and cladding layer 58 of the spring 54. The elements 78 are slit from a larger sheet in the same way as are the springs 54, as set forth above, resulting in flat rectangular blanks, not shown. The blanks are then subjected to a forming process, which is well known in the industry, which upsets the metal and forms a small lateral rib or projection 88 at the center of the blank along both sides as shown in FIG. 8 and 9. The blanks are then inserted into the openings 80 in the disk 76 and the ribs 88 forced into wedging engagement with the sides of the openings 80. This will hold all of the blanks captive in the disk 76 until they are formed into the final c-shape. This forming is done with a pair of forming dies in the usual manner which is typically a two step process. In the first step the outer portions of each end of the blanks are slightly bent in the desired direction of the c-shaped curve, toward the central hole 82 in the present example. The second step consists of final forming to the desired shape depicted in FIG. 8. Each forming step is accomplished with a forming die designed for the purpose. Such forming dies are well known in the metal forming industry and, therefore, will not be described here.

As with the first embodiment, the second embodiment array 52 of contacts is placed against the contacting surface 44 with the projection 30 projecting through the hole 82. The other half 12 of the connector is then brought into alignment and the projection 30 inserted into the bore 32. The two connector halves 12 and 14 are then urged together. As the interlocking fingers 16 begin to lockingly engage, the contacts of the array 42 engage the two contacting surfaces 44 and 48. Relative twisting of the two housing halves 12 and 14 cause a camming action by the fingers 16 to compress the array 52 of resilient contacts a very precise amount until the faces 40 are forced into abutting contact. Additionally, the twisting of the two connector halves 12 and 14 will cause the contacts 61 through 65 to wipe the contacting surface 44 and 48 thereby assuring good electrical contact.

The amount of compression of the coils of the spring 54 in the first embodiment or the c-shaped contact elements 78 in the second embodiment is easily controlled by controlling the depth of the undercut in the face 40 and thereby the distance between the two parallel opposing contacting surfaces 44 and 48. This permits designing the spring 54 and c-shaped elements 78 with a steep force/deflection curve or high spring rate. This results in two important advantages. The first being that the structure of the contacts is of "closed loop" thereby minimizing self-inductance. And the second being that the size of the coil of the spring 54 or the c-shaped element 78 may be minimized thereby minimizing resistance to current flow through the clad layer. Further, by arranging the coils or c-shaped elements close together, mutual inductance is also reduced.

Another embodiment of the present invention substitutes a layer of copper sulfide in place of the layers 58 and 86 of cladding present in the first and second embodiments of the array 52 of contacts. In this embodiment, except for the cladding steps, the manufacturing of the arrays 52 shown in FIGS. 4 and 5 is virtually the same. The copper cladding layer 58 is formed on the surface 60 in a manner that is well known in the art. Typically, a layer of copper having a thickness substantially greater than the desired thickness F of the finished cladding layer 58, as seen in FIG. 4A, is silver soldered to a surface of a sheet of INCONEL X having a thickness slightly greater than the thickness T shown in FIG. 4A. The composite structure is then precision rolled to the desired thickness. It is possible, as an alternative to silver soldering, to attach the layer of copper to the sheet of INCONEL X by thermocompressive bonding during the precision rolling step by providing sufficient heat at the point of bonding. As is the layer of silver and cadmium oxide, the layer of copper is considerably more soft than the INCONEL X and therefor must have a correspondingly greater thickness relative to its final thickness. The rolled composite sheet is then slit into long strips for fabricating the spring 54 and elements 78.

Once the multiple springs 54 and the c-shaped contact elements 78 are formed, the arrays 52 are exposed to a sulfur rich atmosphere in a manner well known in the art to establish a heavy layer of copper sulfide on the exposed surfaces of the copper. In this example, the contacting surfaces 44 and 48 should be copper. When the two connector halves 12 and 14 are assembled, as set forth above, the wiping of the contacts against the contacting surfaces 44 and 48 will substantially deform the copper sulfide layer of the contacts 61 through 65, thereby making good electrical contact. The deformation, however, is permanent thereby rendering the array 52 not reusable. In this case the array 52 would have to be replaced with a new array 52 every time the connector 10 was separated and then reassembled. This would not necessarily be a detriment because, either form of this embodiment could be manufactured inexpensively.

What is claimed is:

1. In an electrical connector for separably connecting two electrical conductors together for carrying relatively high current at high frequency in a high temperature environment, including a first contacting surface electrically connected to one of said conductors and a second contacting surface opposed to said first contacting surface and electrically connecting to the other of said electrical conductors, contact means for providing a current path between said two contacting surfaces comprising a plurality of contacts disposed on a resilient structure, having an arcuate shape and comprising a metal having an annealing temperature substantially above about 300° C., said contacts arranged in pair of proximate contacts so that one contact of one of said pair of contacts is in current carrying engagement with said first contacting surface and the other contact of said pair of contacts is in current carrying engagement with said second contacting surface and each of said contacts is urged by said resilient structure toward its respective contacting surface independent of adjacent contacts.

2. The device set forth in claim 1 wherein said first and second contacting surfaces are substantially parallel and spaced a predetermined distance apart.

3. The device set forth in claim 2 wherein each of said plurality of contacts comprises a layer of material disposed on said resilient structure.

4. The device set forth in claim 3 wherein a portion of said resilient structure having one pair of said pairs of proximate contacts disposed thereon is of arcuate shape and having a substantially rectangular cross section so that a major outer surface thereof includes both of said pair of contacts and said layer of material comprising said contacts is a single layer of material on said major outer surface, thereby providing said current path between said pair of contacts substantially through only said single layer of material.

5. The device set forth in claim 4 wherein said portion of said resilient structure is sized so that said single layer of material thereon has a resistivity of less than about 0.001 ohm $cm^2$ and an inductance of less than about 0.1 mh at a frequency of about 10kHertz.

6. The device set forth in claim 5 wherein said resilient structure comprises an open helical spring and said portion of said resilient structure is a portion of said spring.

7. The device set forth in claim 6 wherein said layer of material comprises a mixture of-between about 70% and about 90% silver and not more than about 30% cadmium oxide.

8. The device set forth in claim 7 wherein each of said first and second contacting surfaces includes a layer of material comprising a mixture of between about 70% and about 90% of silver and not more than about 30% cadmium oxide.

9. The device set forth in claim 5 wherein said resilient structure comprises a plurality of C-shaped members loosely attached to a frame and said portion of said resilient structure is one of said c-shaped members.

10. The device set forth in claim 9 wherein said layer of material comprises a mixture of between about 70% and about 90% silver and not more than about 30% cadmium oxide.

11. The device set forth in claim 10 wherein each of said first and second contacting surfaces includes a layer of material comprising a mixture of between about 70% and about 90% of silver and not more than about 30% cadmium oxide.

12. The device set forth in claim 5 wherein each of said plurality of contacts comprises a layer of sulfide and said first and second contacting surfaces are copper.

13. The device set forth in claim 12 wherein said resilient structure comprises an open helical spring and said portion of said resilient structure is a portion of said spring.

14. The device set forth in claim 13 wherein said resilient structure includes a plurality of open helical springs having a similar diameter and a similar pitch, all of which are arranged in parallel about a common longitudinal axis.

15. The device set forth in claim 14 wherein said contact means includes a support having a substantially spiral shape, said resilient structure being disposed in an open helical pattern along said spiral support.

16. The device set forth in claim 12 wherein said resilient structure comprises a plurality of C-shaped members attached to a frame and said portion of said resilient structure is one of said c-shaped members.

* * * * *

UNITED STATES PATENT AND TRADEMARK OFFICE

CERTIFICATE OF CORRECTION

PATENT NO. : 5,059,143

DATED : October 22, 1991

INVENTOR(S) : Dimitry G. Grabbe

It is certified that error appears in the above-identified patent and that said Letters Patent is hereby corrected as shown below:

Claim 1, column 8, line 56, delete the "." after the "C".

Claim 1, column 8, line 56, delete the word "pair" and insert the word --pairs--.

Claim 7, column 9, line 24 - delete the word "of-between" and insert the words --of between--.

Signed and Sealed this

Thirteenth Day of April, 1993

*Attest:*

STEPHEN G. KUNIN

*Attesting Officer*

*Acting Commissioner of Patents and Trademarks*